US005163671A

United States Patent [19]

Walters

[11] Patent Number: 5,163,671

[45] Date of Patent: Nov. 17, 1992

[54] AUTOMATED SINGLE ROLLER TICKET PROCESSOR WITH PASSIVE TICKET REVERSAL

[75] Inventor: James T. Walters, Oceanside, Calif.

[73] Assignee: International Totalizator Systems, Inc., San Diego, Calif.

[21] Appl. No.: 869,485

[22] Filed: Apr. 15, 1992

[51] Int. Cl.[5] ..... B65H 29/00

[52] U.S. Cl. ..... 271/186; 271/291; 271/902

[58] Field of Search ..... 271/186, 291, 902

[56] References Cited

U.S. PATENT DOCUMENTS 3,523,687 8/1970 Peterson ..... 271/186
4,531,725 7/1985 Seelen ..... 271/186
5,048,814 9/1991 Svyatsky ..... 271/186
5,121,912 6/1992 Tashiro ..... 271/186 X

*Primary Examiner*—Richard A. Schacher
*Attorney, Agent, or Firm*—Baker, Maxham, Jester & Meador

[57] ABSTRACT

A ticket processing system in which a single ticket drive cylinder drives a ticket on a circular ticket guide path past stations for visibly printing and for magnetically encoding or bar encoding the ticket. A passive ticket inverter adjacent the circular ticket guide receives a ticket and guides a first end of the ticket into an inverting space while the drive cylinder rotates the second end of the ticket past the first end and draws the ticket, second end first and inverted, back into the circular ticket guide.

13 Claims, 3 Drawing Sheets

AUTOMATED SINGLE ROLLER TICKET PROCESSOR WITH PASSIVE TICKET REVERSAL

BACKGROUND OF THE INVENTION

The present invention relates to processing of flexible tickets, and more particularly concerns a system for processing tickets having a single cylinder drive mechanism and which includes a mechanism for inverting a ticket so that both faces of the ticket may be processed.

The prior art of ticket processing terminals is exemplified in U.S. Pat. Nos. 4,677,553 and 4,788,419, both assigned in common with this application, and both incorporated herein by reference. In the prior art, a manifest impulse in ticket processing system development has arisen from the need to process both faces of a ticket in the shortest possible time and with a minimal processing structure. By processing is meant the writing of information onto, and reading information off of, one or more faces of the ticket. The incorporated patents illustrate the progress to date in two-face processing of tickets.

FIG. 4 of U.S. Pat. No. 4,677,553 includes a ticket advancing mechanism having a pair of spaced-apart, parallel cylindrical, ticket rollers which move a ticket in a figure-8 pattern for processing on both sides of the ticket. This terminal corresponds to the DM-4 Datamark ticket issuing terminal manufactured and sold by the assignee. This prior art design enables both faces of a ticket to be accessed for processing during a single pass of the ticket through the mechanism because the figure-8 pattern reverses, or inverts, the ticket face in the passage from one roller to the other.

To minimize the size, structural complexity, and cost of ticket processing terminal products, the assignee undertook the development of the single-cylinder ticket advancing terminal described and claimed in U.S. Pat. No. 4,788,419. In this mechanism, a ticket is driven on a circular ticket guide path by a single roller. During a first pass, one face of the ticket is processed and the ticket is expelled from the terminal. Processing of the second ticket phase requires inversion of the ticket by an operator and re-insertion of the inverted ticket into the terminal.

While both prior art mechanisms efficiently and effectively process the two opposing faces of a ticket, the first requires the doubling of structure and control circuitry to support two drive rollers. The second mechanism reduces the proliferation of parts and circuitry by use of a single drive cylinder, but at the cost of lengthening the time to process both faces of a ticket.

Therefore, there is an evident need for a ticket terminal with a processing mechanism which will maintain the minimum part count resulting from the use of a single drive cylinder, yet which will process both faces of a ticket in a minimum amount of time.

It is, therefore, an object of the present invention to provide a compact, fast ticket processing mechanism which will process both faces of a ticket in a mechanism which employs a single ticket drive cylinder.

SUMMARY OF THE INVENTION

The invention is founded on the inventors' critical observation that a ticket can be inverted in a ticket processing terminal utilizing a single cylinder for advancing the ticket around a circular guide path by driving the ticket partially out of the path so that a first end of the ticket extends out of the path, stopping pivoting the second end of the ticket past its first end by retaining the second end in engagement with the drive cylinder. Pivoting inverts the ticket in the guide path so that a first face of the ticket is disengaged from the drive cylinder at the same time that the drive cylinder engages the second face.

Accordingly, the invention is a method and means for inverting a ticket in a ticket processing system, the invention including:

a housing;

a cylindrical ticket guide path on the housing;

a single drive cylinder rotationally mounted in the housing and surrounded by the ticket guide path for engaging and driving a ticket around the ticket guide path in a first revolutionary direction or in a second revolutionary direction opposite the first revolutionary direction, the ticket being driven in either revolutionary direction with a longitudinal axis extending between first and second ends of the ticket substantially aligned with the first and second revolutionary directions;

a ticket input in the housing for feeding a first end of a ticket into the ticket guide path so that the drive cylinder engages and drives the ticket around the ticket guide path in the first revolutionary direction with a first side of the ticket engaging the drive cylinder;

a passive ticket inverter mounted in the housing adjacent the drive cylinder for temporarily receiving a ticket, the inverter including at least one surface for guiding a first end of the ticket out of the cylindrical guide while a second end of the ticket is retained against the drive cylinder, engagement of the second end causing the ticket to be drawn back into driving engagement with the drive cylinder for continued driving of the ticket around the ticket guide path in the first revolutionary direction with a longitudinal axis of the ticket substantially aligned with the first revolutionary direction and with a second side of the ticket engaging the drive cylinder; and a ticket output for engaging the second end of the ticket when the ticket is driven around the ticket guide path in the second revolutionary direction and directing the ticket out of the ticket guide path.

Accordingly, another objective of this invention is to provide, in a ticket processing terminal with a single drive cylinder ticket advancing mechanism, an inverter for passively inverting a ticket being driven in a circular ticket guide path by the drive cylinder.

It will become evident that these objectives and other attendant advantages are realized by the practice of this invention when the following detailed description is read with reference to the below-described drawings.

DETAILED DESCRIPTION OF THE PREFERRED EMBODIMENT

Figure 1:
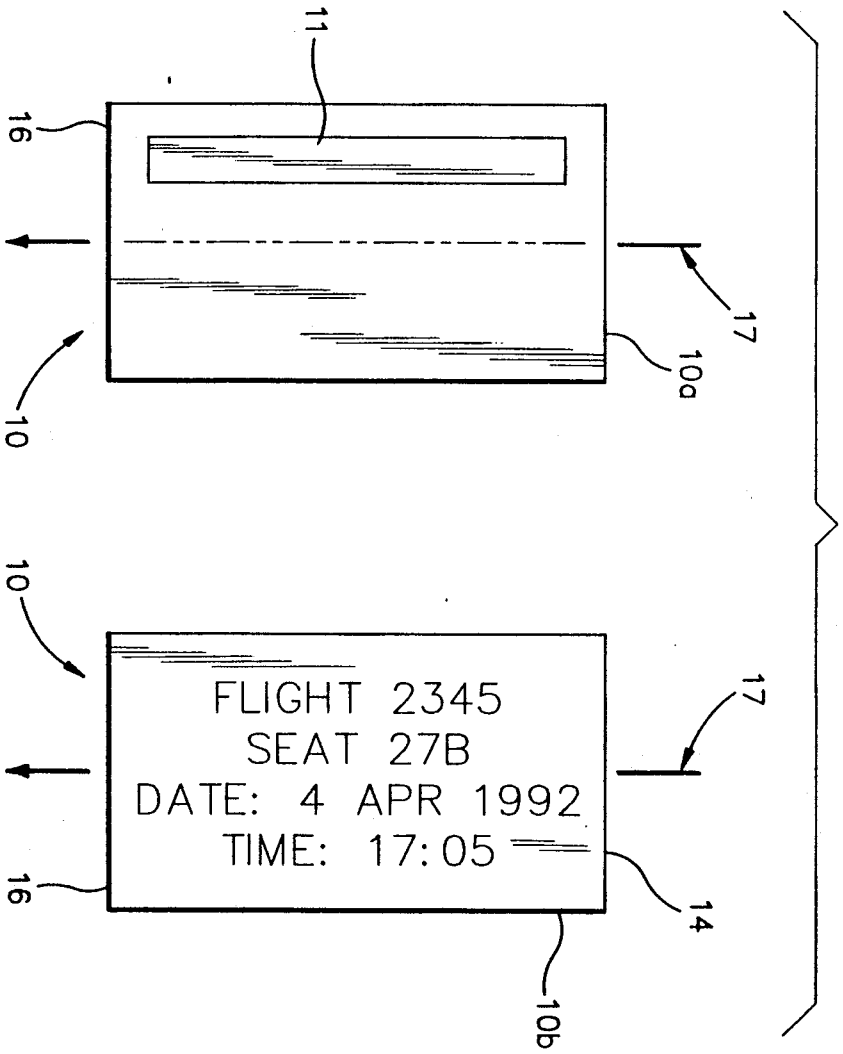
FIG. 1 is an illustration of a ticket with two faces.

When used herein, the term "ticket" refers generally to an elongate flexible card or document with a means for receiving magnetically-encoded or bar-encoded information and visibly printed information. Such a ticket is indicated in FIG. 1 by reference numeral 10. Reference numeral 10*a* shows one face (or "side") of the ticket 10, while the other face is indicated by reference numeral 10*b*. The invention enables the processing of information on each side of the ticket 10, without regard to the form in which the information appears on the ticket. The ticket 10 may have the general structure and characteristics of, for example, a flight coupon serving as a passenger ticket, baggage check, and boarding pass with the additional capacity to carry magnetically-encoded information. Relatedly, the ticket may have a stripe 11 of magnetically-encoded material and may be visibly imprinted on side 10*b*. The ticket 10 has two ends 14 and 16 and a generally longitudinal axis 17 extending between the ends 14 and 16. As is known, tickets such as the ticket 10 are fully described by IATA Specifications 1722-C and -D, Resolutions 20-13, 20-14, and 20-20.

Preferably, the invention is a ticket processing mechanism which employs a single roller for advancing a ticket such as the ticket 10 through a series of processing steps in which the ticket is visibly printed and magnetically written and read. As the magnetic strip is on one face of the ticket 10 and printing must be done on the opposite face of the ticket, it will be necessary to flip or invert such a ticket to perform both functions. The invention takes advantage of the spring-like qualities of a ticket undergoing slight bending to efficiently and effectively perform the inverting as illustrated in FIG. 2 and 3.

Figure 2:
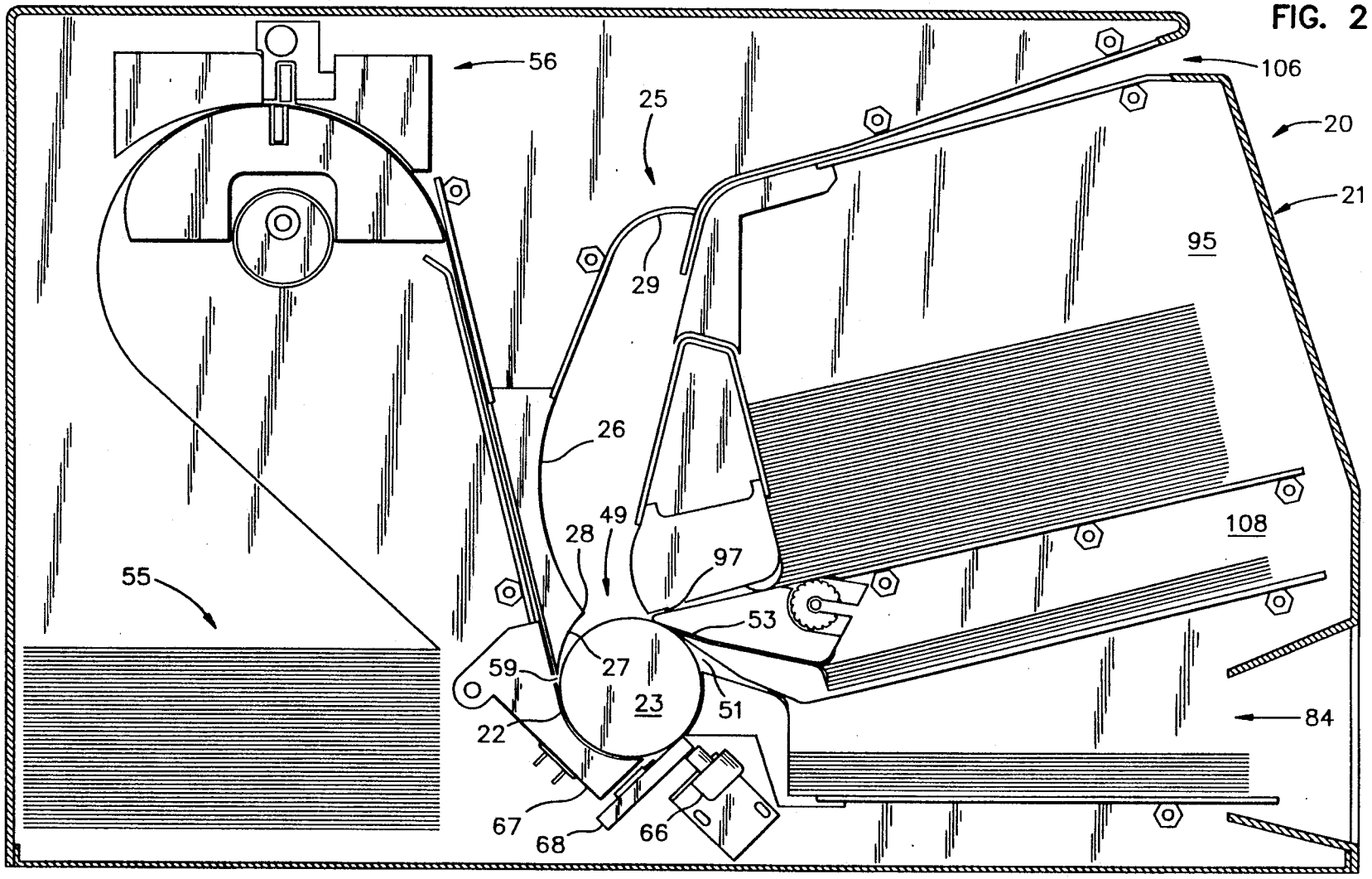
FIG. 2 is a side elevation of a ticket processing system open on one side to show the operative environment, structure, and operation of the invention.
Figure 3:
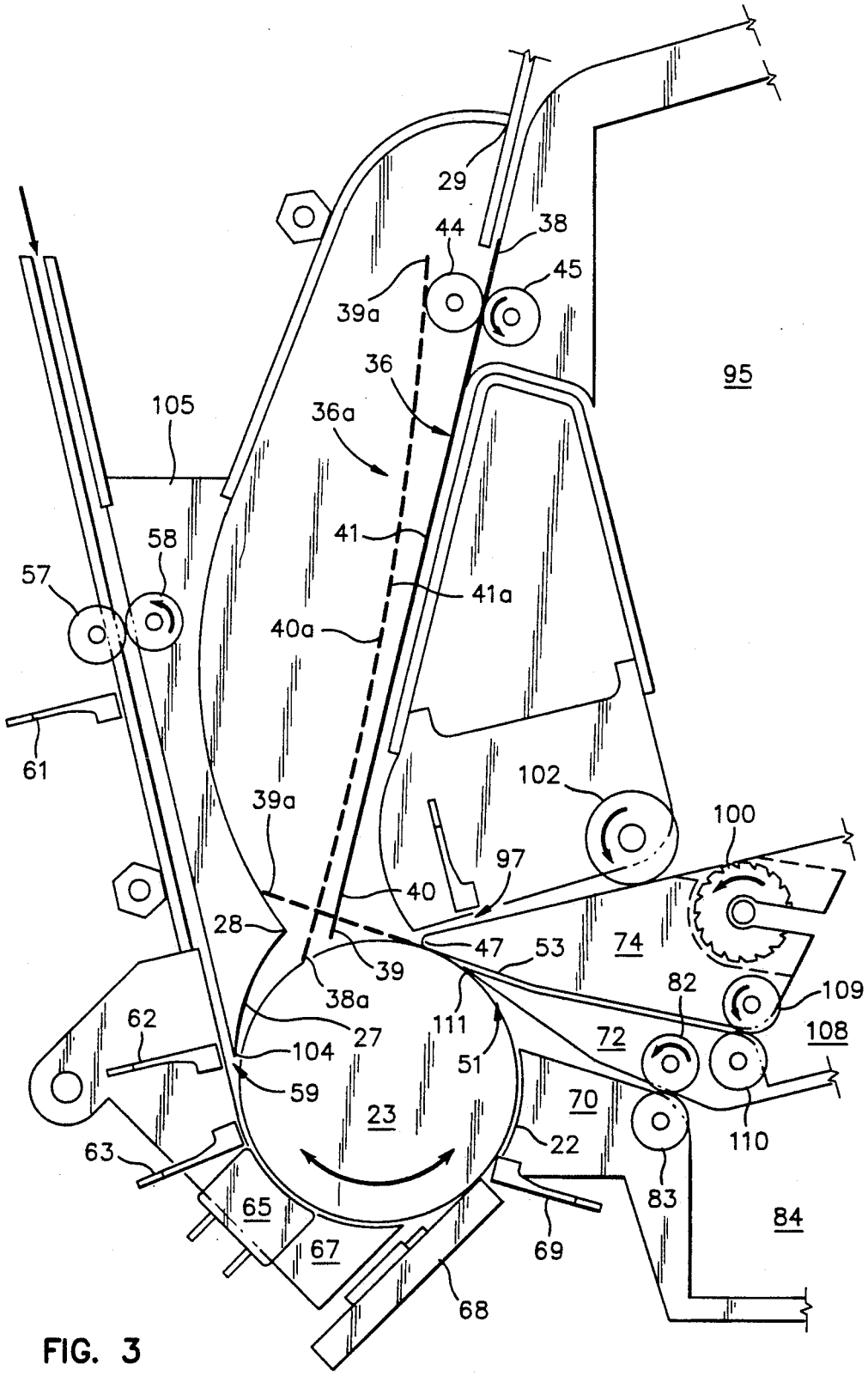
FIG. 3 is an enlarged view of a passive ticket inverter according to the invention.

FIGS. 2 and 3 illustrate a ticket processing system 20 with a ticket inverting mechanism according to the invention. The ticket processing system 20 is enclosed in housing 21 having internal structure which defines a cylindrical or circular ticket guide 22. A ticket is advanced along a revolutionary path around the ticket guide 22 by a rotating drive cylinder 23. The drive cylinder 23 is conventionally mounted on the circular ticket guide 22 to rotate therein in either a first or second revolutionary direction. The drive cylinder is conventionally powered by a reversible, high speed motor controlled by a processor in the processing system. A ticket inverting mechanism indicated generally by 25 is positioned above the drive cylinder and adjacent the ticket guide 22. The ticket inverting mechanism 25 includes a curved upper surface 26 and a curved lower surface 27, with the curved lower surface being positioned generally adjacent the drive cylinder 23. The curved upper and lower surfaces 26 and 27 meet in a cusp 28. In the preferred embodiment of the invention, the curved upper surface 26 transitions at its upper end to a surface portion 29.

The ticket inverting mechanism 25 is intended to invert or to "flip" a ticket which is moving in a revolutionary direction in the circular ticket guide 22. A representative ticket is indicated by reference numeral 36, and extends between an end 38 and an end 39. The ticket has a first face 40 and a second face 41. Preferably, the length of the ticket between the ends 38 and 39 is approximately three quarters of the circumference of the drive cylinder 23, although this dimension may be varied to fit particular design considerations.

The operation of the ticket inverting mechanism 25 can be understood with reference to the ticket 36, assuming that the ticket is driven into the circular ticket guide 22 between feed rollers 44 and 45. As the ticket 36 is driven toward the ticket guide 22, eventually, the first end 39 and the face 40 will be engaged by the drive cylinder 23 and the ticket will be driven in a first revolutionary direction (CCW) in the circular ticket guide with the first end 39 being the leading edge, the face 40 being engaged by the drive cylinder 23, and the face 41 facing the circular ticket guide 22. As the drive cylinder 23 continues to rotate in the first revolutionary direction, eventually the leading end of the ticket will reach a point 47 in the circular ticket guide 22. Between the point 47 and the cusp 28 is an arcuate opening 49 (shown in FIG. 2) in the circular ticket guide 22. When the leading edge of the ticket 36 reaches the point 47, the natural resilience of the ticket stock will cause the leading end of the ticket to spring away from the drive cylinder and travel a path which is tangential to the circular ticket guide at the point 47; this tangential path eventually causes the leading end of the ticket to engage the curved upper surface 26 above the cusp 28. This is illustrated in FIG. 3 by reference numeral 39*a* which corresponds to the first end 39 of the ticket 36. As the drive cylinder 23 continues to rotate in the first revolutionary direction, the curved upper surface 26 will guide the first end 39*a* of the ticket 36 until the entire ticket is in the inverting mechanism. When in the inverting mechanism, the trailing end of the ticket is retained against the drive cylinder 23 by the force of gravity as indicated by reference numeral 38*a* in FIG. 3. The outer surface of the drive cylinder is sheathed in a relatively thin layer of a rubber-like material which maintains a good frictional engagement with the cardboard material of the ticket. The engagement between the trailing end 38*a* and the outer surface of the drive cylinder 23 will pivot the second end of the ticket past the first end and draw the ticket 36*a* back into the circular ticket guide 22 with the faces inverted. In this regard, when the ticket 36 is initially drawn by the drive cylinder 23 into the circular ticket guide 22, the face 40 engages the cylinder 23, while the face 41 faces the ticket guide 22. Now, with the ticket positioned as indicated by 36*a*, when the second end 38*a* is drawn into the ticket guide 22, the face 41 will engage the drive cylinder 23, while the face 40 will face the ticket guide 22. This is indicated in FIG. 3 by face 41*a* which is identical with, but oppositely oriented from, face 41 of the ticket 36 and by the face 40*a* which is identical with, but oppositely directed from, the face 40 of the ticket 36. Thus inverted, the ticket will continue to be driven in the first revolutionary direction by the drive cylinder 23 with the sides inverted and the ends transposed. In this latter regard, the end 38*a* will now be the leading end.

Retention of the second end of the ticket against the outer surface of the drive cylinder 23 is key to operation of the invention, for it is the continued motion of the cylinder in the first revolutionary direction which moves the second end of the ticket past the first end and re-engages the ticket in the ticket guide 22. In the preferred embodiment, the vertical arrangement of the ticket inverter 25 and the drive cylinder 23, with the inverter above the drive cylinder keeps the trailing end of the ticket against the drive cylinder. Those skilled in the art will appreciate that other means may be employed to keep the ticket trailing end against the drive cylinder while the ticket is in the inverter. For example, the surface portion 29 may be spaced from the drive cylinder 23 by a distance which is less than the length of a ticket. This will flex the ticket and press the trailing end against the drive cylinder. Alternatively, the leading end may be nipped between rollers disposed in the inverter toward the upper end of the guide surface at a distance which flexes the ticket against the drive roller. Neither of these latter two embodiments requires placement of the ticket inverter vertically above the drive roller 23.

As can be appreciated with reference to FIG. 3, without reversing the CCW rotation of the drive cylinder 23, ticket 36 will be inverted or "flipped" with each revolution of the drive cylinder 23. Extraction of the ticket 36 from the circular ticket guide 22 requires reversal of the direction in which the drive cylinder 23 revolves. For example, assume that the end 39*a* of the ticket 36 has engaged the curved upper surface 26 while the drive cylinder 23 is rotating CCW. If the rotation of the drive cylinder 23 is reversed before the trailing end of the ticket reaches the point 47 in the circular ticket guide 22, but after it has passed either of the ports 51 or 53, a complete CW revolution of the drive cylinder 23 will drive the ticket out of the circular ticket guide 22 through one of these ports.

With the foregoing explanation, processing of both sides of the ticket in the ticket processing system of FIGS. 2 and 3 will now be described. Preferably, new tickets are fed into the circular ticket guide 22 from an accordian-folded length of blank ticket stock 55. A new ticket is advanced to the guide 22 by the roller pair 57, 58 through the input port 59. A sensor 61 detects the leading edge of the new ticket and triggers a cutting mechanism 56 which operates conventionally to separate the new ticket from the ticket stock 55. The new ticket is advanced by the rollers 57, 58 until its leading edge is detected by an escrow station sensor 62. The ticket is held with its leading edge at the escrow station sensor 62 until it is needed, at which time the rollers 57, 58 will be activated to drive the ticket into to the circular ticket guide 22 and the drive cylinder 23 will be rotated CCW. Preferably, the ticket is oriented such that its face with the magnetic stripe is oriented toward the circular ticket guide 22. When the leading end of the ticket reaches a magnetic write/read (MWR) head sensor 63, a magnetic write/read head assembly 65 will be activated to first write, and then read magnetic information in the magnetic stripe of the ticket. The write/read sequence is employed to validate information written in the magnetic stripe and also to store the information, if necessary, to be printed on the ticket in visible form as explained below. As the drive cylinder 23 continues to rotate in the CCW direction, the leading edge of the ticket is driven past the magnetic write/read assembly 65, the end of a magnetic block 67 which positions the assembly 65 adjacent the circular ticket guide 22, a printhead block 68 holding a thermal printhead, a ticket-under-printhead (TUP) sensor 69, an output hopper block 70, a capture block 72, a lower feed block 74, and the point 47 where the leading edge of the ticket travels tangentially to the curved upper surface 26 of the ticket inverting mechanism 25. As explained above, the ticket's lead end travels up the curved upper surface 26 and the ticket is inverted in the ticket inverting mechanism 25 and drawn back into the circular ticket guide 22. When the now-leading (formerly trailing) end of the ticket reaches the TUP sensor 69, a printhead solenoid 66 is energized and the printhead block 68 is positioned against the ticket. The block's thermal printhead is energized and visible printing is placed on the ticket face opposite that which carries the magnetic stripe. The visible printing operation is conventional, requiring a CCW stepping of the drive cylinder 23 in synchronism with operation of the solenoid 66 driving the printhead block 68. The printhead 69 can operate according to any of a variety of well-known visible printing techniques, including thermal printing, ink printing, laser printing, and any equivalent.

As the printing operation proceeds, the ticket continues to be driven in the CCW direction by rotation of the drive cylinder 23. Eventually, the trailing edge of the ticket will pass under the TUP sensor 69. Immediately following the printing operation, when the trailing edge is detected at 69, the CCW stepping of the drive cylinder 23 continues for an appropriate number of steps to position the trailing edge of the ticket in the gap 51 between the output upper block 70 and the capture block 72. At this point, the rotation of the drive cylinder 23 is reversed, the trailing edge of the ticket again becomes the leading edge, and the ticket is driven into the output hopper 84 with the help of auxiliary drive rollers 82 and 83.

A hopper 95 may contain a number of pre-cut tickets or coupons which are escrowed for a purpose other than the purpose intended for tickets fed through the input port 59. Tickets are fed singly from the hopper 95 through the auxiliary input port 97 by a CCW-rotating feed roller 100 and counter rotating "soft throat" ticket separator roller 102. In this regard, the roller 102 is spaced from the path of travel of a ticket being input by the drive roller 100 by an amount sufficient to engage a second ticket which may be dragged by the ticket being fed. The counter rotating roller 102 will prevent the second ticket from riding "piggyback" into the auxiliary feed port 97 on the ticket being fed therethrough by the roller 100. A ticket is fed through the auxiliary feed port 97 on a direction of travel which is tangential to the drive cylinder 23 and which contacts the curved lower surface 27 of the ticket inverting mechanism beneath the cusp 28. This forces the leading edge to the lower point 104 of the inverter block 105 where it engages the drive roller 23 and is drawn thereby into the circular ticket guide 22. Tickets fed in this manner from the hopper 95 can be processed for magnetic or visible printing as described above and can be output through the exit port 51 or the capture port 53 as required by operational considerations.

A third input path is through an opening 106, between the rollers 44 and 45. This input path is fed manually by a processing system operator and is intended for revalidation of previously-issued tickets which may not be used. These tickets enter through the opening 106 in the upper right side of the ticket inverting mechanism, travel past the stop surface 29, pass between the rollers 44 and 45, and are advanced into the circular ticket guide 22. If a ticket is inserted in this manner for the purpose of validating its magnetic information, a validation procedure may be commenced when the ticket's leading edge is sensed by the sensor 63. The ticket may then be output through the output port 51 or the capture port 53.

Last, the output hopper 84 is provided for output of validated tickets which are to be delivered for ticketholders. The output hopper is fed through the output port 51. A capture hopper 108 is also provided to capture defective tickets which may have been written or printed incorrectly and which are not intended to be provided to a ticketholder. Tickets are placed in the capture hopper 108 by advancing a ticket in the CCW direction in the ticket guide 22 until its trailing edge is between the point 47 and the tip 111 of the capture block 72. At this point, the direction of rotation for the drive cylinder 23 is reversed, the ticket is driven into the capture port 53 and fed into the capture hopper 108 between rollers 109 and 110.

The construction of the ticket inverter and other described mechanisms is conventional, the circular ticket guide 22, the inverter surface, and the parts in FIGS. 2 and 3 are provided as surfaces on contoured blocks and plates mounted in the housing. The drive cylinder may be rotationally mounted and powered by a reversible stepper motor (not shown) as disclosed in U.S. Pat. No. 4,788,419.

The mechanization used to electronically control the operations of ticket advancing portions of the processing system illustrated in FIGS. 2 and 3 are conventional. An exemplary configuration including a processor assembly for implementing control functions is shown in FIG. 8 of U.S. Pat. No. 4,788,419. It will be evident to those well-versed in the art that the control mechanization can be conventionally mounted on one or more printed circuit boards located within the housing of the processing system and connected by conventional signal conduction means to the various components of the ticket advancing mechanism of FIG. 3.

Last, the invention has been explained in the context of processing a ticket with magnetic information on one side and printed information on the other. In fact, this is not meant to limit the invention's practice which can be in any context requiring access to both sides for processing.

While I have described a preferred embodiment of our ticket inverter, it should be understood that modifications and adaptations thereof will occur to persons skilled in the art. Therefore, the protection afforded our invention should only be limited in accordance with the scope of the following claims.

I claim:

1. A ticket processing terminal, comprising:

a housing;

guide path means mounted in said housing for defining a substantially cylindrical ticket guide path;

drive cylinder means mounted in said housing and surrounded by said guide path means for engaging and driving a ticket around said ticket guide path in a first revolutionary direction in response to a first drive signal and in a second revolutionary direction opposite said first direction, said ticket being driven with a longitudinal axis of said ticket extending between a first end and a second end thereof substantially aligned with said first and second revolutionary directions;

ticket input means mounted in said housing for feeding said first end of a ticket into said ticket guide path so that said drive cylinder means will engage and drive said ticket around said ticket guide path in said first ticket around said ticket guide path in said first revolutionary direction with a first side of said ticket being engaged by said drive cylinder means;

passive ticket inverter means mounted in said housing adjacent said cylinder means for temporarily receiving said ticket from said ticket guide path, said passive ticket inverter means including at least one wall for guiding said first end of said ticket out of said ticket guide path while said second end is maintained in driving engagement with said drive cylinder means for continued driving of said ticket around said ticket guide path in said first revolutionary direction with the longitudinal axis of said ticket substantially aligned with said first revolutionary direction and with a second side of said ticket being engaged by said cylinder means; and ticket output means for engaging an end of said ticket when said ticket is driven around said ticket guide path in said second revolutionary direction and directing said ticket out of said ticket guide path.

2. A ticket processing terminal according to claim 1, wherein said ticket guide path and said wall of said passive inverter means join to define a cusp adjacent to said drive cylinder means, said cusp having a first curved surface portion facing said drive cylinder means and a second curved surface portion facing away from said drive cylinder means, said first end of said ticket engaging said second curved surface portion of said cusp upon entering said passive inverter means and engaging said first curved surface portion of said cusp upon leaving said passive inverter means.

3. A ticket processing terminal according to claim 2, wherein first curved surface portion of said cusp forces said second end of said ticket into said ticket guide path.

4. A ticket processing terminal according to claim 1, wherein said passive ticket inverter means is positioned substantially vertically above said drive cylinder means, said second end being maintained in driving engagement with said drive cylinder means by gravity.

5. A ticket processing terminal according to claim 1, wherein said wall of said passive inverter means is curved and transitions to a stop surface including a generally V-shaped bend in an outer end of said wall.

6. A ticket processing terminal according to claim 5, wherein the distance between said stop surface and a surface of said cylinder means being less than a longitudinal dimension of said ticket between said first and second ends thereof, said wall being configured to cause said ticket to bend and said second end to be maintained in driving engagement with said cylinder means surface.

7. A ticket processing terminal according to claim 1, wherein said ticket input means feeds said ticket into said ticket guide path through a region also utilized by said passive inverter means to receive and invert said ticket.

8. A ticket processing terminal according to claim 1 and further comprising means mounted in said housing adjacent said ticket guide path for placing first data on said ticket.

9. A ticket processing terminal according to claim 8, and further including second means mounted in said housing adjacent said ticket guide path for placing second data on said ticket when said ticket is inverted following placing said first data on said ticket.

10. A ticket processing terminal according to claim 1, and further comprising print means mounted in said housing adjacent said ticket guide path for printing visible information on said ticket.

11. A ticket processing terminal, comprising:

a housing;

guide path means mounted in said housing for defining a substantially cylindrical ticket guide path;

drive cylinder means mounted in said housing and cooperating with said guide path means for engaging and driving a ticket around said ticket guide path in a first revolutionary direction and in a second revolutionary direction opposite said first revolutionary direction, said ticket being driven with a longitudinal axis of said ticket extending between a first end and a second end thereof substantially aligned with said first and second revolutionary directions;

a ticket input means mounted in said housing for feeding said first end of a ticket into said ticket guide path so that said drive cylinder means will engage and drive said ticket around said ticket guide path in said first revolutionary direction with a first side of said ticket facing said drive cylinder means; and a ticket inverter means mounted in said housing adjacent said drive cylinder means for temporarily receiving said ticket from said ticket guide path, said ticket inverter means including at least one wall for guiding said first end of said ticket out of said ticket guide path, said ticket inverter means further for maintaining said second end in engagement with said drive cylinder means while said drive cylinder means drives said second end pivotally past said first end such that said ticket is engaged at said second end for driving said ticket around said ticket guide path in said revolutionary direction with the longitudinal axis of said ticket substantially aligned with said first revolutionary direction and with a second side of said ticket facing said cylinder means.

12. The ticket processing terminal of claim 11, further including:

a ticket output means for engaging said second end of said ticket when said ticket is driven around said ticket guide path in said second revolutionary direction.

13. An apparatus for processing a flexible card having two ends and a longitudinal axis extending between said ends and further having a first face and a second face, the apparatus comprising:

a housing;

a guide path means in the housing for defining a curved guide path;

drive cylinder means received in the guide path means for driving a flexible card in the curved guide path in a revolutionary direction which is substantially aligned with the longitudinal axis of the flexible card;

an opening in the guide path means for permitting an end of a flexible card being driven in the revolutionary direction to travel on an inverting path which is tangential to the curved guide path; and a passive inverter means communicating with the opening for receiving a flexible card traveling on the inverting path such that one end of the flexible card is maintained in engagement with the drive cylinder means, the one end being driven by the drive cylinder means pivotally past the other end and back into the curved guide path.

* * * * *

UNITED STATES PATENT AND TRADEMARK OFFICE

CERTIFICATE OF CORRECTION

PATENT NO. : 5,163,671

DATED : November 17, 1992

INVENTOR(S) : Walters

It is certified that error appears in the above-identified patent and that said Letters Patent is hereby corrected as shown below:

Col 7, line 55, please delete "in said first ticket around said ticket guide path".

Signed and Sealed this

Thirtieth Day of November, 1993

*Attest:*

*Attesting Officer*

Bruce Lehman

BRUCE LEHMAN

*Commissioner of Patents and Trademarks*